US005985045A

United States Patent [19]

Kobayashi

[11] Patent Number: 5,985,045

[45] **Date of Patent: *Nov. 16, 1999**

[54] PROCESS FOR POLISHING A SEMICONDUCTOR SUBSTRATE

[75] Inventor: Thomas S. Kobayashi, Austin, Tex.

[73] Assignee: Motorola, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,483

[22] Filed: Feb. 25, 1997

Related U.S. Application Data

[63] Continuation of application No. 08/327,771, Oct. 24, 1994, abandoned.

[51] Int. Cl.[6] ..... C23C 8/00

[52] U.S. Cl. ..... 148/240; 134/7; 156/153; 438/693; 451/36

[58] Field of Search ..... 148/240; 451/36; 134/7; 156/153; 438/693

[56] References Cited

U.S. PATENT DOCUMENTS

| | | | |
|---|---|---|---|
| 3,286,992 | 11/1966 | Armeniades et al. | 259/4 |
| 3,635,444 | 1/1972 | Potter | 259/4 |
| 3,738,882 | 6/1973 | Basi | 156/636.1 |
| 3,893,655 | 7/1975 | Sandiford | 259/4 |
| 3,979,239 | 9/1976 | Walsh | 156/636.1 |
| 4,021,278 | 5/1977 | Hood | 156/636.1 |
| 4,059,929 | 11/1977 | Bishop | 51/263 |
| 4,322,460 | 3/1982 | Howe | 427/426 |
| 4,378,509 | 3/1983 | Hatchett et al. | 307/528 |
| 4,477,494 | 10/1984 | Ali Zaidi | 427/426 |
| 4,517,222 | 5/1985 | Blegen | 427/426 |
| 4,543,366 | 9/1985 | Smith | 427/426 |
| 4,745,011 | 5/1988 | Fukuta | 427/426 |
| 5,032,203 | 7/1991 | Doy et al. | 156/345 |
| 5,407,526 | 4/1995 | Danielson | 156/636.1 |
| 5,525,191 | 6/1996 | Maniar et al. | 156/636.1 |
| 5,750,440 | 5/1998 | Vanell et al. | 438/692 |

FOREIGN PATENT DOCUMENTS

| | | |
|---|---|---|
| 63-258629 | 10/1988 | Japan . |
| 1499622 | 1/1993 | U.S.S.R. . |

OTHER PUBLICATIONS

Cook, "Chemical Processes In Glass Polishing;" Journal of Non–Crystalline Solids 120; pp. 152–171, (1990).

*Primary Examiner*—David A. Simmons
*Assistant Examiner*—Robert R. Koehler
*Attorney, Agent, or Firm*—George R. Meyer

[57] ABSTRACT

A chemical-mechanical polisher (10) includes a mixer section (12) that mixes components of a polishing fluid prior to introducing the polishing fluid into a polishing section (13) of the polisher (10). In one embodiment, components from feed lines (113 and 114) are combined in a manifold (121) and flowed through a static in-line mixer (123) to mix the components to form the polishing fluid. The polishing rate of the polishing fluid is relatively high because the mixing occurs near the point of use. Local concentrations of the components of the polishing fluid near a substrate (134) should be relatively uniform because the polishing fluid is mixed prior to reaching the substrate (134).

30 Claims, 2 Drawing Sheets

PROCESS FOR POLISHING A SEMICONDUCTOR SUBSTRATE

RELATED APPLICATION

This application is a continuation of prior patent application Ser. No. 08/327,771 filed Oct. 24, 1994, now abandoned. This is related to U.S. patent application Ser. No. 08/559,669 filed Nov. 20, 1995, now U.S. Pat. No. 5,570,440.

FIELD OF THE INVENTION

The present invention relates to chemical-mechanical polishing of semiconductor substrates, and in particular, to delivering a polishing fluid to a polisher.

BACKGROUND OF THE INVENTION

Chemical-mechanical polishing is commonly used in semiconductor fabrication for planarization, fabrication of contact or via plugs, or fabrication of in-laid interconnects. In the polishing process, a polishing slurry that has particles may be used. The polishing slurry may mechanically and chemically etch the surface of the substrate or an overlying layer. Although polishing slurries may be formulated in a ready-to-use form, many polishing slurries are formulated as a concentrated form or formulated to keep components separate. A polishing slurry in a ready-to-use form includes a large amount of water. Shipping costs for water is expensive due to its density.

In some polishing slurries, polishing particles may change the pH of the slurry. For example, a tungsten polishing slurry may include an aqueous solution of alumina particles and an acid. Alumina particles have an iso-electric point that is basic that can make the polishing slurry more neutral when exposed to the acid for a period of time. A tungsten polishing slurry may have a polishing rate after 15 days that is about a quarter of the initial polishing rate when the components are first mixed. A similar effect occurs with a polishing slurry that includes an aqueous solution of oxide particles in a base because oxide particles have an iso-electric point that is acidic.

To overcome those problems, the polishing slurry may be made by batch mixing near the point of use or by mixing components on a platen of a polisher. With batch mixing, the polishing slurry may be mixed in a large tank. These tanks may be about 300–340 liters (80–90 gallons) but may have volumes of several hundred liters. For one specific process that is used to remove oxide from semiconductor substrates, about 200 liters (55 gallons) of polishing slurry may polish around 400 wafers. The batch mixing still has the problem of a non-stable pH that translates into a variable polishing rate.

The polishing rate of a tungsten polishing slurry including an aqueous solution of alumina particles and an acid may be about 3100 angstroms per minute just after mixing, about 2000 angstroms per minute about one day after mixing, about 1100 angstroms per minute about three days after mixing, and levels off at about 900 angstroms per minute starting at about 15 days after mixing. Assuming that a polishing can polish about 10 wafers an hour, 400 wafers would take about a day and a half to polish. If the 400 wafers were polished after mixing, the first wafer would polish at about 3100 angstroms per minute, and the last wafer would polish at about 1600 angstroms per minute. This highly variable polishing rate makes process control difficult. Although the polishing rate stabilizes at a polishing rate of about 900 angstroms per minute, this rate is too low for production.

Batch mixing has other problems. The mixing tank has to be cleaned each time the solution is changed. Also, lifting and transporting the components for the slurry is difficult due to their densities. Further, the fluid within the tank has to be maintained such that it remains mixed and prevents formation of a gel. When the additional components are added, they need to be completely mixed with the polishing fluid that already exists within the tank. Even after mixing, the polishing rate may need to be characterized because the tank now includes a mixture of fresh and old polishing slurries.

A plurality of feed lines may be directed to dispense directly on to a platen within a chemical-mechanical polisher. One problem with this method is that the components may not properly mix, thereby forming localized regions that are more concentrated with one component versus the other.

SUMMARY OF THE INVENTION

The present invention includes a chemical-mechanical polisher for polishing a semiconductor substrate comprising: a first feed line having an outlet; a second feed line having an outlet; a mixing section having an inlet and an outlet; and a tub capable of receiving an effluent from the outlet of the mixing section. The outlets of the first and second feed lines are connected to the inlet of the mixing section.

The present invention also includes a process for polishing a semiconductor substrate comprising the steps of: placing the semiconductor substrate in a chemical-mechanical polisher; and polishing the semiconductor substrate using a polishing fluid. The step of polishing includes a step of providing the polishing fluid to the substrate that includes steps of: flowing a first fluid through a first feed line having an outlet; flowing a second fluid through a second feed line having an outlet; mixing the first and second fluids within a mixing section to form the polishing fluid; and flowing the polishing fluid through the outlet of the mixing section to provide the polishing fluid to the semiconductor substrate. The mixing section has an inlet and an outlet, and the outlets of the first and second feed lines are connected to the inlet of the mixing section.

Other features and advantages of the present invention will be apparent from the accompanying drawings and from the detailed description that follows.

BRIEF DESCRIPTION OF THE DRAWINGS

The present invention is illustrated by way of example and not limitation in the figures of the accompanying drawings, in which like references indicate similar elements, and in which.

DETAILED DESCRIPTION OF DRAWINGS

A chemical-mechanical polisher includes a mixer section that mixes components of a polishing fluid prior to introducing the polishing fluid into the polishing section of the polisher. The polishing rate of the polishing fluid is relatively high because the mixing occurs near the point of use. Local concentrations of the components of the polishing fluid near the substrate should be relatively uniform because the polishing fluid is mixed prior to reaching the substrates. The present invention is better understood after reading the sections below.

Polishing Embodiment

Figure 1:
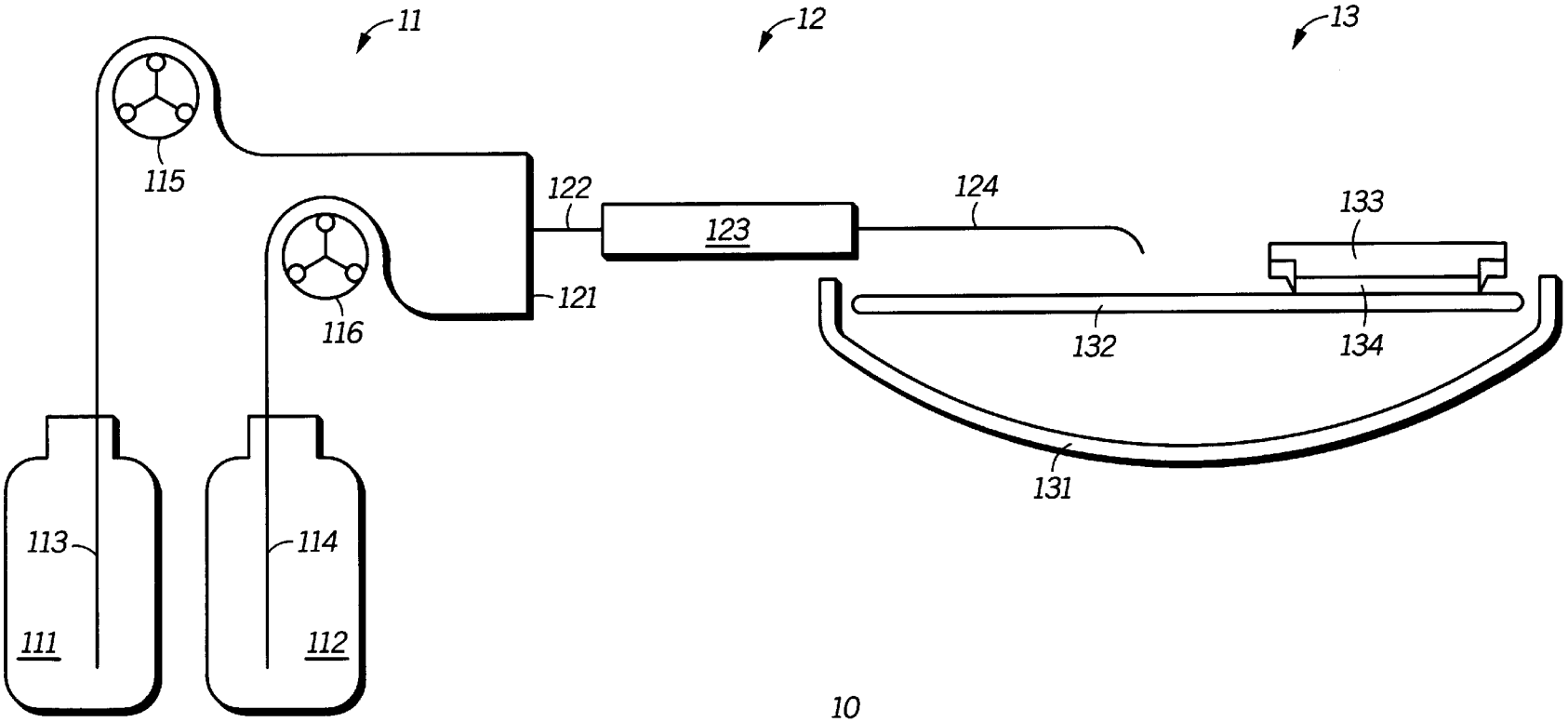
FIG. 1 includes a schematic view of a chemical-mechanical polisher in accordance with one embodiment of the present invention.

FIG. 1 includes a schematic view of a portion of a chemical-mechanical polisher 10. The chemical-mechanical polisher 10 has three sections that include a feed section 11, a mixing section 12, and a polishing section 13. Within the feed section are two containers 111 and 112. The two containers 111 and 112 include components of a polishing fluid. For example, container 111 may include concentrated polishing fluid, and container 112 includes a diluent, such as water, an alcohol, a glycol, and the like. Similarly, containers 111 and 112 may include components, when in the presence of each other, that affect the polishing rate over time. The components within the containers 111 and 112 flow through the feed lines 113 and 114, respectively, to a manifold 121. Pumps 115 and 116 regulate the flow through the feed lines 113 and 114, respectively.

The mixing section 12 includes the manifold 121 that is used to combine the two feed lines 113 and 114, each having an outlet. The inlets to the manifold 121 are the inlets to the mixing section 12. After combining the components from the feed lines 113 and 114 in the manifold 121, the components flow through tubing 122 to a static in-line mixer 123. The components from the containers 111 and 112 are turbulently mixed within the static in-line mixer 123 to form a polishing fluid. The polishing fluid is typically a liquid or a slurry. The polishing fluid then flows through a piece of tubing 124 that is the outlet for the mixing section 12. The polishing fluid is the effluent from the mixing section 12. The mixing section is initially where components from the feed lines initially contact one another.

The polishing fluid flows into the chemical-mechanical polishing section 13. The polishing section 13 includes a tub 131, a platen 132 and a polishing pad. For simplicity, the combination of the platen and polishing pad is just denoted as the platen 132. Above the platen 132 is a substrate holder 133 and a semiconductor substrate 134. During polishing, the polishing fluid is eventually received by the tub 131, at which time, the polishing fluid may be recycled or discarded.

The static in-line mixer 123 thoroughly mixes the components flowing through the feed lines 113 and 114 so that the polishing fluid is completely mixed by the time it reaches the polishing section. Therefore, the components from the feed lines 113 and 114 should have a turbulent flow through the in-line mixer 123. The design of the mixer should be such that turbulence is achieved for the designed flow rates. For example, if a polishing fluid is to be delivered at a flow rate between 100–200 milliliters per minute, the mixer should be design such that the turbulence is achieved even when the polishing fluid flow rate is as low as 100 milliliters per minute. Usually, the polishing fluid flow rate is no higher than 500 milliliters per minute.

Figure 2:
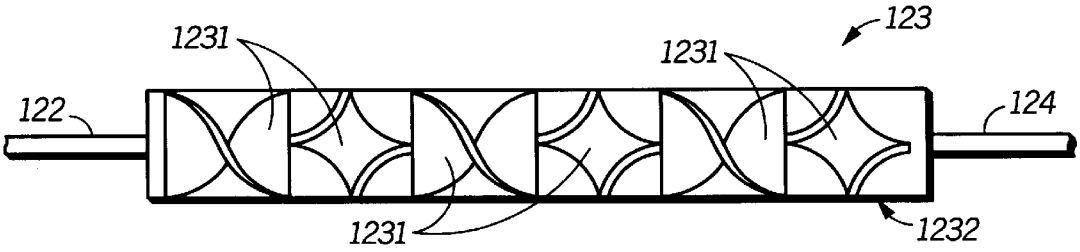
FIG. 2 includes an illustration of a cross-sectional view of an in-line mixer.

FIG. 2 includes an illustration of a cross-sectional view of the static in-line mixer 123. The mixer 123 has helical plates 1231 within a shell 1232. At the first plate 1231, the fluid stream is bisected and rotated. At the second plate, about half of each of the fluid streams on each side of the first plate are combined and rotated along each side of the second plate. The mixer is "static" because it has no moving parts.

Figure 3:
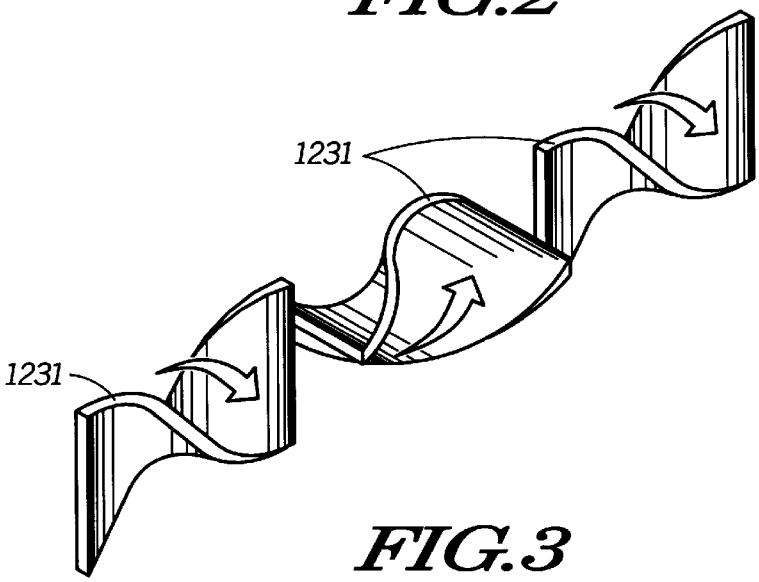
FIG. 3 includes an illustration of a perspective view of plates of FIG. 2 showing how fluid flows around the plates.

FIG. 3 includes a perspective view of some of the plates 1231. FIG. 3 shows how the plates are placed in relation to each other and how the fluid flows around the plates as illustrated by the arrows. In this particular embodiment, the helical plates 1231 are arranged such that the direction rotation of the fluid is reversed compared to the previous plate. In other words, the fluid rotates in one direction in the first plate and rotates in the opposite direction in the second plate. The mixer 123 as shown in FIG. 2 has six plates. The static in-line mixer may have any finite number of plates. For example, the mixer may have an overall length of about 35 centimeters (14 inches) and include 27 plates in another embodiment. The mixer should include a material that is resistant to attack by the components being mixed. If the components form an acidic or basic solution, the in-line mixer may include stainless steel, monel (an alloy including nickel, copper, iron, and manganese), or the like.

The apparatus as shown in FIG. 1 may be used to polish semiconductor substrates. The polishing parameters should be relatively similar to existing polishing methods except that now a relatively constant polishing rate may be achieved. On average, the polishing rate should be higher than what is typically achieved for batch mixing. Constant adjustment of polishing time should not be necessary. Also, the polishing fluid should not have local regions of varying concentration of individual components when the polishing fluid is delivered to the polishing section 13.

Alternate Embodiments

Any number of containers may be used to feed the system, although only two are shown within FIG. 1. The containers may include different types of particles that are to be mixed. The containers may be inside or outside the polisher itself. Similarly any number of feed lines may be used. The number of containers may be less than the number of feed lines. For example, a first feed line may be connected to a container, and a second feed line may supply a diluent, such as deionized water. The manifold would be designed to accommodate the actual number of feed lines used.

The number of pumps used is typically the same or less than the number of feed lines. In one embodiment, a feed line may be a tap from an in-house deionized water system. A pump may not be necessary between the tap and the manifold 121. A flow regulator may be required to adjust for pressure changes within the deionized water system. The pumps may be controlled dependently or independently of one another. The control of the pumps may be performed by a human, a computer, or a master-slave relationship. If the pumps are controlled by a master-slave relationship, the pump heads may be connected to the same pump motor. If this occurs, the pumping rates of the two pumps should pump in a fixed ratio for a given flow. Flow measuring apparati (not shown) may be installed to monitor flow rates. The flow rates may be displayed or be an electronic signal going to the computer that controls the pumps.

Figure 4:
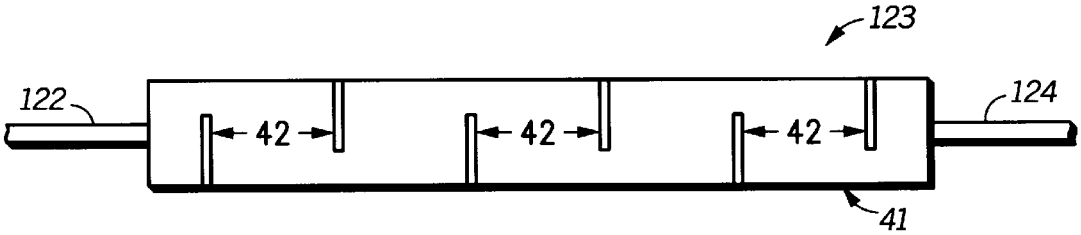
FIG. 4 includes an illustration of a cross-sectional view of an in-line mixer in accordance with an alternate embodiment.

In an alternate embodiment the helical plates can be replaced by baffles 42 as shown in FIG. 4. With the in-line mixer 123, the baffles 42 generally extend from the wall 41 about ¾ of the distance to the opposite wall in a direction perpendicular to the length of the mixer. The baffles 42 are spaced such that the components flow in a serpentine path through the in-line mixer 123. The serpentine path for the flow should mix component prior to leaving the mixer 123. In another embodiment, the baffles may be replaced by one or more venturis or plates with openings (i.e., orifice plates). In yet another embodiment, the in-line mixer 123 may not be needed if the components may be effectively mixed within the manifold 121.

In still a further embodiment, the manifold 121 and tubing 122 are not needed if the mixer 123 is capable of receiving a plurality of feed lines.

In one embodiment, equal volumes of fluid may flow through each of the feed lines to more efficiently mix the components within the in-line mixer 123. If a highly concentrated polishing fluid is being used, the design of the feed and mixing sections may need modified. As an example, assume that a concentrated polishing solution is to be diluted such that the concentrated polishing solution makes up one quarter of the volume of the polishing fluid delivered to the polishing section. In this case, two feed lines having equal volumes of concentrated polishing solution and diluent are fed through a first manifold and are mixed in a first in-line mixer. The effluent from the first in-line mixer is combined an equal volume of diluent within a second manifold and are mixed in a second in-line mixer. The effluent from the second in-line mixing is the polishing fluid. The concentrated polishing solution makes up about one quarter of the polishing fluid.

The design of the in-line mixers may be used to accommodate nearly any concentration of components. Each mixer may form a stage. The previous embodiment has two stages. If the concentrated polishing solution is to be diluted, so that it makes up one eighth of a polishing fluid, three stages may be used. For a one-sixteenth dilution, four stages may be used. Any finite number of stages may be used. Also, a similar design may be used when active components are combined in ratios other than 1:1. Therefore, dilution rates do not need to be a factor of two. Virtually any dilution ratio may be achieved.

Figure 5:
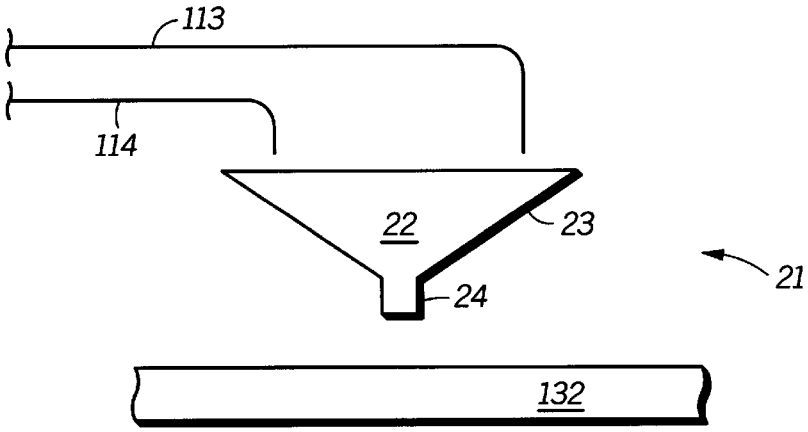
FIG. 5 includes a schematic view of an alternate embodiment including a funnel for mixing the components for the polishing fluid.

Previous embodiments included a sealed in-line mixer. By sealed, it is meant that the mixing does not occur while the components are exposed to air. The mixer does not need to be sealed. In one embodiment, the mixing may occur by using a funnel 22, as shown in FIG. 5. The two feed lines 113 and 114 flow into the funnel inlet 23, which is the conical section of the funnel. During the traversal of the components through the funnel 22, the components may swirl around to become mixed. Upon mixing, a polishing fluid is formed and is an effluent that leaves through the outlet 24 onto the platen 132. Different flow patterns may be used within the funnel 22. Both of the feed lines may be pointed directly down into the funnel similar to that as shown in FIG. 4. In still another embodiment, the direction of the components may be directed in directions along the inner edge of the funnel whereas the components flow in the same direction or in opposite directions. In any event, the flow of the components through the funnel 22 should be such that the polishing fluid as it leaves the outlet 24 should be completely mixed.

Although not shown, additional valves and lines may be included to clean or flush the manifold 121 and mixer 123 or the funnel 22. The cleaning or flushing may be performed on a timely basis (i.e., daily, weekly, or the like) or on a substrate frequency basis (i.e., every 50 substrates, every 500 substrates, each lot of substrates, every 10 lots, or the like).

A polishing fluid may include only liquids or include at least one liquid and particles. In many chemical-mechanical polishes, a polishing slurry is used. A polishing slurry is a type of polishing fluid that includes at least one liquid and particles.

Benefits

A benefit of the present invention includes better control over polishing. The mixing occurs near the point of use that allows the polishing rate to be relatively high and less time variable than batch mixing. Also, the polishing characteristics for the embodiments of the present invention should be relatively uniform across a substrate because the polishing fluid is mixed prior to reaching the substrate. In other words, the polishing fluid is not being initially mixed by the motion of a substrate across a polishing pad. With the present invention, polishing parameters may be established that are consistent from substrate-to-substrate and lot-to-lot. This better control allows the polishing operation to be more automated without having to occasionally running test substrates (as opposed to product substrates).

Because the polishing fluid is initially mixed near the point of use, the polishing fluid should have a higher polishing rate than is achievable with a batch mixing system. As such, more substrates may be polished over a period of time compared to batch mixing. Further, the present invention does not have the problem of a different polishing rate when new components are added to an existing mixture within a tank. The present invention uses fluid dynamics to mix the components as they flow to the polisher.

Another benefit of the present invention is that less waste should be generated compared to a batch mixing system. When the mixing section 12 is flushed or cleaned, only those portions of the components within the mixing section 12 are not used. In general, this volume is less than one liter and may be in a range of 50–250 milliliters. With a batch mixing system, typically at least four liters, and usually more than ten liters, of polishing fluid is affected. Almost always, the tank for batch mixing system is located outside the polisher. In addition to waste, the lifting and transporting of components and maintenance requirements for the tank are virtually eliminated.

Still yet another benefit is that a sealed mixer may be used. A hood is not required to exhaust fumes. Further, if any of the components of the polishing solution is affected or reacts with air, the sealed mixer delays exposure until the polishing fluid is near the platen 132.

As previously pointed out, the components are not mixed on the polishing pad. If the components are mixed on the polishing pad, some of the mixing typically occurs by the polishing of the substrate itself. The chances of having an unusual local polishing rate for each substrate are virtually eliminated when using the present invention.

Because any number of components may be used in formulating the polishing fluid, components may be stored such that they have a virtually infinite shelf life prior to mixing. More specifically, components that may affect or react with one another are kept in separate feed lines prior to reaching the in-line mixer. By segregating the components in this fashion, it is possible to store the components for a long period of time without having to worry about diminishing polishing rates from a polishing fluid whose components have been mixed together prior to entering the feed lines.

In the foregoing specification, the invention has been described with reference to specific embodiments thereof. However, it will be evident that various modifications and changes can be made thereto without departing from the broader spirit or scope of the invention as set forth in the appended claims. Accordingly, the specification and drawings are to be regarded in an illustrative rather than a restrictive sense.

I claim:

1. A process for polishing a semiconductor substrate comprising:

placing the semiconductor substrate in a chemical-mechanical polisher; and polishing the semiconductor substrate using a polishing fluid including:

flowing a first fluid through a first feed line;

flowing a second fluid through a second feed line;

mixing the first and second fluids within the polisher to form the polishing fluid; and flowing the polishing fluid through a tube before reaching the semiconductor substrate.

2. The process of claim 1, wherein mixing is performed using an in-line mixer.

3. The process of claim 1, wherein flowing the polishing fluid is performed such that the polishing fluid flows at a rate in a range of 100–500 milliliters per minute.

4. The process of claim 2, wherein mixing is performed such that the in-line mixer comprises comprising a feature selected from a group consisting of a baffle, a venturi, and a helical plate.

5. The process of claim 1, wherein the first and second fluids initially contact each other during mixing.

6. The process of claim 1, wherein:

flowing the first fluid is performed such that the first fluid includes polishing particles; and flowing the second fluid is performed such that the second fluid includes a component.

7. The process of claim 6, wherein the component is an acid or a base.

8. The process of claim 1, wherein the second fluid is a diluent.

9. The process of claim 1, wherein mixing is performed within a manifold.

10. The process of claim 1, wherein mixing comprises:

combining the first and second fluids within a manifold to form a combined fluid, wherein the first and second fluids initially contact each other when they are combined; and flowing the combined fluid through an in-line mixer.

11. The process of claim 10, wherein mixing further comprises a step of flowing the combined fluid through a tube before reaching the in-line mixer.

12. The process of claim 2, wherein the in-line mixer has no moving parts.

13. A process for polishing a semiconductor substrate comprising:

placing the semiconductor substrate in a chemical-mechanical polisher; and polishing the semiconductor substrate using a polishing fluid including:

flowing a first fluid through a first feed line into an open end of a funnel, wherein the open end is exposed to an oxygen-containing gas;

flowing a second fluid through a second feed line into the open end of the funnel;

mixing the first and second fluids within the funnel to form the polishing fluid; and flowing the polishing fluid out of the funnel to provide the polishing fluid to the semiconductor substrate.

14. The process of claim 13, wherein:

flowing the first fluid is performed such that the first fluid includes polishing particles;

flowing the second fluid is performed such that the second fluid includes a component; and the polishing particles and component initially contact during mixing.

15. The process of claim 13, wherein:

flowing the first fluid is performed such that the first fluid includes polishing particles; and flowing the second fluid is performed such that the second fluid includes a diluent.

16. The process of claim 13, wherein flowing the second fluid is performed such that the second fluid includes a diluent only.

17. The process of claim 13, wherein:

flowing the first fluid is performed such that the first fluid includes polishing particles; and flowing the second fluid is performed such that the second fluid includes an acid.

18. The process of claim 1, wherein mixing is performed turbulently.

19. A process for polishing a semiconductor substrate comprising:

placing the semiconductor substrate in a chemical-mechanical polisher; and polishing the semiconductor substrate using a polishing fluid including:

flowing a first fluid through a first feed line;

flowing a second fluid through a second feed line;

mixing the first and second fluids within a first mixer to form an effluent;

flowing an effluent from the first mixer;

flowing a third fluid through a third feed line;

mixing the effluent and the third fluid within a second mixer to form the polishing fluid; and flowing the polishing fluid out of the second mixer to provide the polishing fluid to the semiconductor substrate.

20. The process of claim 19, wherein mixing is performed such that at least one of the first and second mixers is an in-line mixer.

21. The process of claim 20, wherein the in-line mixer comprises a feature selected from a group consisting of a baffle, a venturi, and a helical plate.

22. The process of claim 19, wherein flowing the polishing fluid is performed such that the polishing fluid flows at a rate in a range of 100–500 milliliters per minute.

23. The process of claim 19, further comprising combining the first and second fluids before mixing the first and second fluids.

24. The process of claim 23, further comprising flowing the first and second fluid through a tube between combining and mixing the first and second fluids.

25. The process of claim 23, wherein:

flowing the first fluid is performed such that the first fluid includes polishing particles;

flowing the second fluid is performed such that the second fluid includes a component selected from an acid, a base, or a diluent; and the polishing particles and component initially contact during combining.

26. The process of claim 25, wherein the third fluid included an acid or a base.

27. The process of claim 25, wherein the third fluid is a diluent.

28. The process of claim 19, further comprising combining the effluent and the third fluid before mixing the effluent and the third fluid.

29. The process of claim 28, further comprising flowing the effluent and the third fluid through a tube between combining and mixing the effluent and the third fluid.

30. The process of claim 19, wherein mixing the effluent and the third fluid is performed turbulently.

* * * * *